US008918949B2

(12) United States Patent
Petersen

(10) Patent No.: US 8,918,949 B2
(45) Date of Patent: Dec. 30, 2014

(54) PAINT DISTRIBUTING PLATE SYSTEM

(76) Inventor: Jan Henrik Petersen, Hvidovre (DK)

( * ) Notice: Subject to any disclaimer, the term of this patent is extended or adjusted under 35 U.S.C. 154(b) by 0 days.

(21) Appl. No.: 13/988,277

(22) PCT Filed: Nov. 15, 2011

(86) PCT No.: PCT/EP2011/070111
§ 371 (c)(1),
(2), (4) Date: Jul. 9, 2013

(87) PCT Pub. No.: WO2012/069336
PCT Pub. Date: May 31, 2012

(65) Prior Publication Data

US 2013/0291330 A1 Nov. 7, 2013

(30) Foreign Application Priority Data

Nov. 24, 2010 (DK) ..... 2010 01063

(51) Int. Cl.
*B05C 21/00* (2006.01)
*B44D 3/12* (2006.01)

(52) U.S. Cl.
CPC ..... *B44D 3/128* (2013.01); *B44D 3/126* (2013.01)
USPC ..... 15/257.05; 15/257.06; 220/529; 220/570; 220/692; 220/699; 220/700

(58) Field of Classification Search
CPC ..... B44D 3/12; B44D 3/126; B44D 3/128
USPC ..... 15/257.05, 257.06; D32/53.1; 220/529, 220/570, 692, 694, 695, 699, 700
See application file for complete search history.

(56) References Cited

U.S. PATENT DOCUMENTS 2,893,030 A 7/1959 Linn et al.
5,283,928 A 2/1994 Averna
(Continued)

FOREIGN PATENT DOCUMENTS

DE 102 45 190 B3 2/2004
DE 10 2008 014706 A1 9/2009
(Continued)

OTHER PUBLICATIONS

International Search Report completed Apr. 2, 2012 for International Application No. PCT/EP2011/070111.

*Primary Examiner* — Monica Carter
*Assistant Examiner* — Michael Jennings
(74) *Attorney, Agent, or Firm* — Brinks Gilson & Lione

(57) ABSTRACT

There is provided a paint distributing plate system for insertion into a paint bucket having an external upper rim. The paint distributing plate system comprises a paint distributing plate with a lower part and an upper part, where the lower part has a width being smaller than the diameter of the largest cross-sectional dimension of the paint bucket, and a pair of adjustable attachment hook arrangements provided on the upper part of the paint distributing plate, one on each side of the paint distributing plate, for securing the paint distributing plate to the upper rim of the paint bucket. It is preferred that each of the adjustable attachment hook arrangements comprises an elongated fastening strip with a hook at one end thereof, and a locking profile secured to one side of the upper part of the distributing plate, where the locking profile locks the fastening strip with the hook extending a distance below the locking profile, said distance being adjustable, whereby the hook arrangement can be adjusted to fit to paint bucket upper rims of different widths or heights.

16 Claims, 6 Drawing Sheets

(56) References Cited

U.S. PATENT DOCUMENTS

| | | | | |
|---|---|---|---|---|
| 7,036,182 | B2 * | 5/2006 | Bukovitz et al. | 15/257.06 |
| 7,137,168 | B2 * | 11/2006 | Mann | 15/257.06 |
| 2004/0049876 | A1 * | 3/2004 | Bukovitz et al. | 15/257.06 |
| 2005/0039294 | A1 | 2/2005 | Mann | |
| 2005/0235449 | A1 * | 10/2005 | Kochler | 15/257.06 |
| 2006/0064843 | A1 * | 3/2006 | Maria Cornelissen | 15/257.06 |

FOREIGN PATENT DOCUMENTS

| | | | |
|---|---|---|---|
| EP | 2 025 533 | A1 | 2/2009 |
| WO | WO 94/23958 | A1 | 10/1994 |

* cited by examiner

PAINT DISTRIBUTING PLATE SYSTEM

This application claims the benefit under 35 U.S.C. §371 of International Application No. PCT/EP2011/070111, filed Nov. 15, 2011, which claims The benefit of Danish Application No. PA201001063, filed Nov. 24, 2010, Which are incorporated by reference herein in their entirety.

FIELD OF INVENTION

The present invention relates to a paint distributing plate system for insertion into a paint bucket having an external upper rim.

BACKGROUND OF THE INVENTION

In WO 94/23958 a paint distributing plate for insertion into a paint bucket is disclosed. The plate has a lower part that is narrower than the paint bucket to which the plate is inserted and an upper part having a width that is larger than the width of the lower part. The upper part has side flanges on each side, where the lower end of the side flanges form hook-like parts, which can be placed against the upper edge of the paint bucket for keeping the plate in its position relative to the paint bucket. It is noted that the plate is not secured to the paint bucket by the side-flange hooks, and when lifting the paint distributing plate, the plate will leave the paint bucket.

However, when painting a larger surface, the paint bucket and the paint tools have to be moved several times, and during such movement it is an advantage if the paint distributing plate is secured to the paint bucket. It is an object of the present invention to provide a paint distributing plate system, where the paint distributing plate can be secured to the paint bucket

SUMMARY OF THE INVENTION

According to the present invention there is provided a paint distributing plate system for insertion into a paint bucket having an external upper rim, the paint distributing plate system comprising:

- a paint distributing plate with a lower part and an upper part, the lower part having a width being smaller than the diameter of the largest cross-sectional dimension of the paint bucket, and
- a pair of adjustable attachment hook arrangements provided on the upper part of the paint distributing plate, one on each side of the paint distributing plate, for securing the paint distributing plate to the upper rim of the paint bucket.

It is preferred that one or each of the adjustable attachment hook arrangements comprises: an elongated fastening strip with a hook at one end thereof, and a locking profile secured to one side of the upper part of the distributing plate, said locking profile locking the fastening strip with the hook extending a distance below the locking profile, said distance being adjustable, whereby the hook arrangement can be adjusted to fit to paint bucket upper rims of different widths or heights. Here, the locking profile and the hook may be designed so that the upper part of the upper rim of a paint bucket can rest against a lower part of the locking profile and the lower part of the upper rim of the paint bucket can be hold by the hook.

It is preferred that the locking profile has an aperture through which a part of the fastening strip is inserted and further has locking means locking the inserted fastening strip to the locking profile with the hook extending a distance below the locking profile, said distance being adjustable and being a function of the length of the part of the fastening strip being inserted through the aperture. It is also preferred that the fastening strip is releasably locked to the locking profile.

It is within an embodiment of the invention that the hook of the elongated fastening strip is facing a first side surface of the strip and the fastening strip further has a plurality of ribs and grooves extending along a second side surface opposing the first side surface of the strip. The fastening strip may be inserted through the aperture with the hook being below the aperture of the locking profile and facing the distribution plate, and with part of the ribs and grooves extending above the aperture. Preferably, the locking profile further has a locking pin fitting into a groove of the second side surface of the fastening strip thereby locking the fastening strip to the locking profile. The locking pin may be arranged at the locking profile with the aperture positioned between the distributing plate and the locking pin, and the locking profile may further hold a locking support arranged at the other side of the aperture opposing the locking pin, whereby the fastening strip is locked between the locking support and the locking pin.

According to an embodiment of the invention the ribs may have a plane lower surface for contacting the locking pin, and the ribs may have a sloping or tilted upper surface. Preferably, the locking pin can be bent at its position at the locking profile, thereby allowing the fastening strip to be pulled further through the locking aperture and allowing the locking pin to be locked into another groove of the fastening strip. The aperture of the locking profile may be arranged at a distance from the side of the paint distributing plate, thereby making space for the upper rim of the paint bucket.

According to an embodiment of the invention, a handle aperture is formed in the upper part of the paint distributing plate. It is preferred that the paint distributing plate comprises a number of paint distributing ridges serving as wiping elements for a paint brush or a paint roller. It is also preferred that the paint distributing plate is provided with a through-flow opening at the bottom of the lower part.

The present invention also covers an embodiment wherein the upper part of the paint distributing plate comprises a pair of side flanges, one on each side of the paint distributing plate, which side flanges extend in an angle to the plate. Here, the lower end of each of the side flanges may be connected to a locking profile being part of the hook arrangement.

BRIEF DESCRIPTION OF THE DRAWINGS

Embodiments of the invention will now be described with reference to the accompanying drawings, wherein.

DETAILED DESCRIPTION OF EMBODIMENTS OF THE INVENTION

Figure 1:
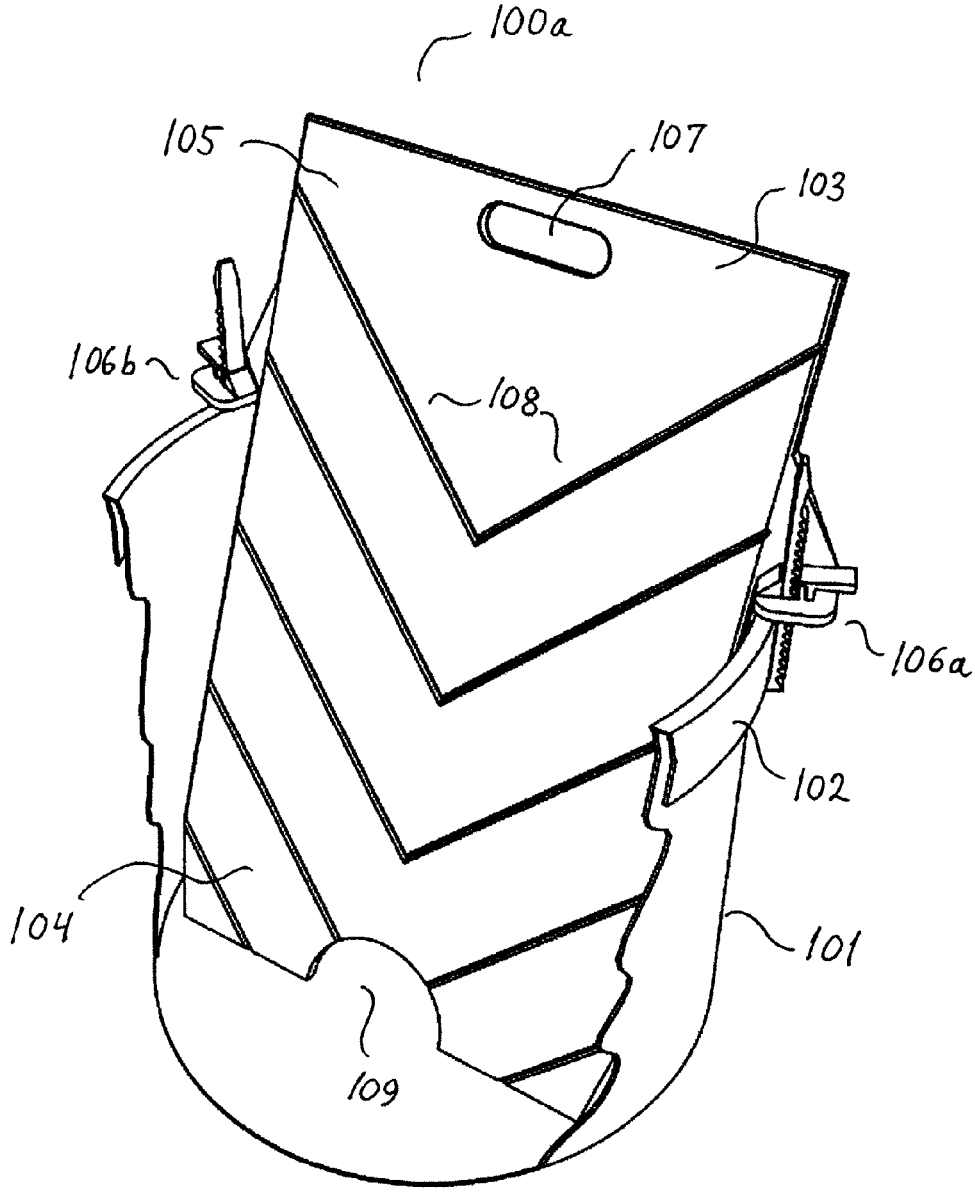
FIG. 1 is a perspective view of a first embodiment of a paint distributing plate system according to the invention, shown placed in a paint bucket, which has been cut for reasons of clarity.

FIG. 1 is a perspective view of a first embodiment of a paint distributing plate system 100*a* according to the invention. The system 100*a* is shown placed in a paint bucket 101 with an upper rim 102, where the bucket 101 is shown cut for reasons of clarity.

The paint distributing plate system 100*a* has a paint distributing plate 103 with a lower part 104 and an upper part 105, where the lower part 104 has a width being smaller than the diameter of the largest cross-sectional dimension of the paint bucket 101. The plate system 100*a* further has a pair of adjustable attachment hook arrangements 106*a*, 106*b* provided on the upper part 105 of the paint distributing plate 103 with one on each side of the plate 103. The hook arrangements 106*a*, 106*b* can be adjusted to secure the paint distributing plate 103 to the upper rim 102 of the paint bucket 101.

A handle aperture 107 is formed in the upper part 105 of the paint distributing plate 103. Thus, when the plate 103 is secured to the bucket rim 102 by adjustment of the hook arrangements 106*a*, 106*b* it may be possible to lift both the plate 103 and the bucket 101 by lifting the plate 103, where the handle aperture 107 may be used. The paint distributing plate 103 may comprise a number of paint distributing ridges 108 serving as wiping elements for a paint brush or a paint roller, and a through-flow opening 109 may be provided at the bottom of the lower part 104 of the plate 103.

Figure 2:
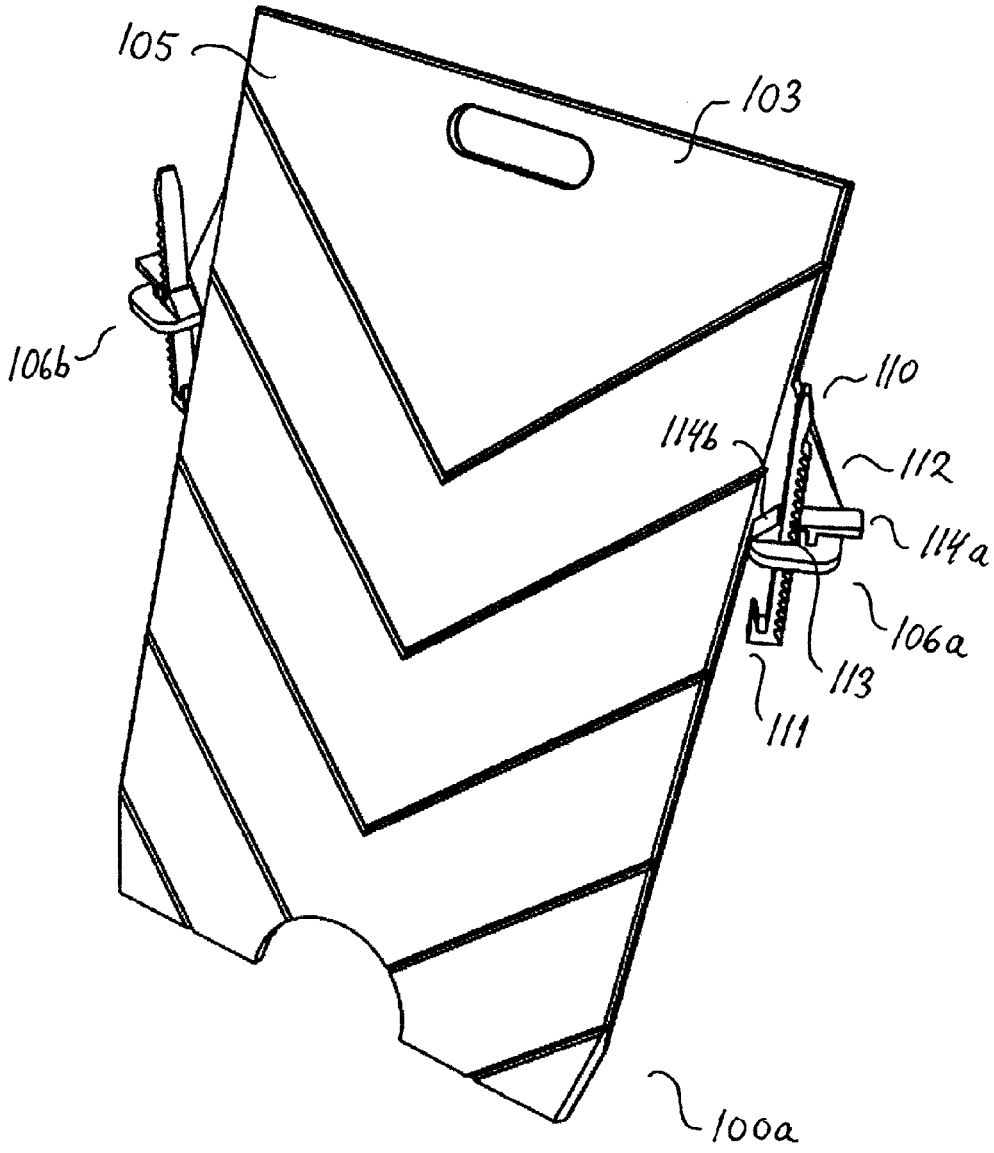
FIG. 2 is a front view of the paint distributing plate system only of FIG. 1.
Figure 3:
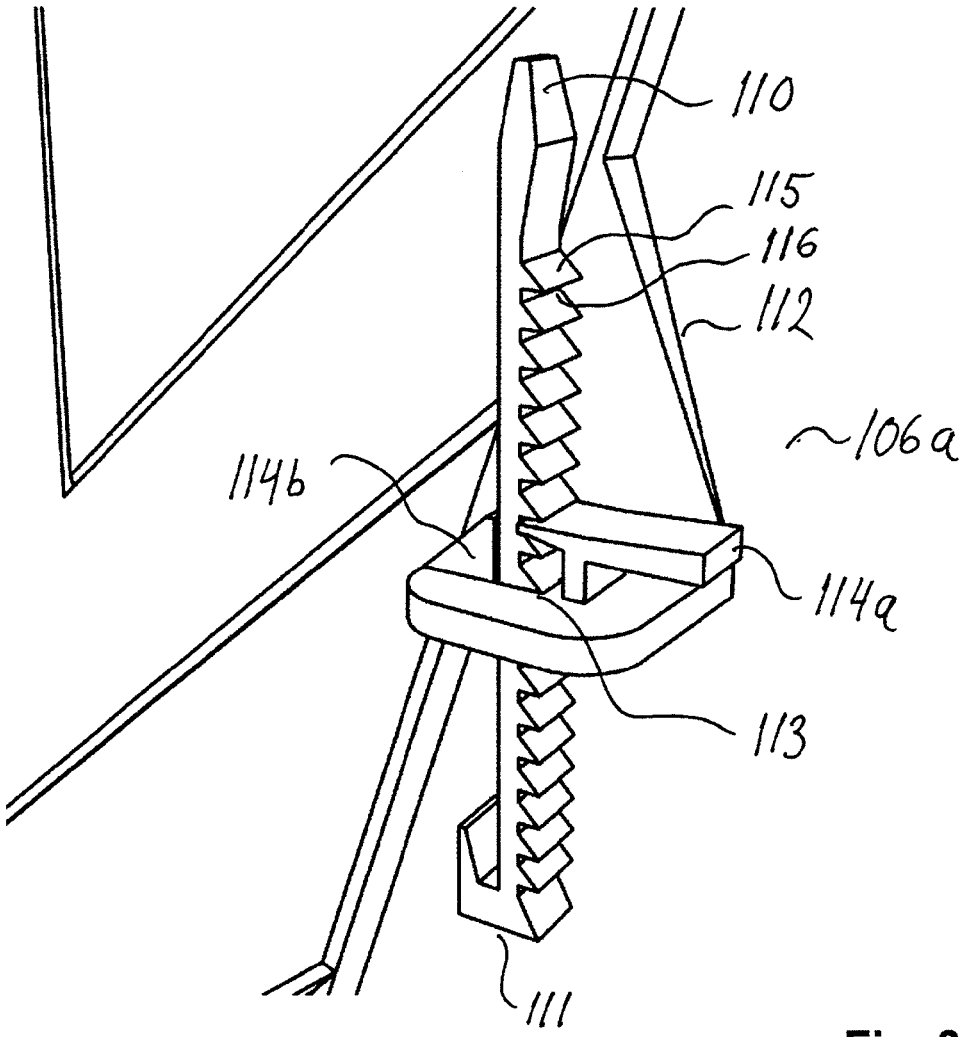
FIG. 3 is a more detailed view of the adjustable attachment hook arrangement of the plate system of FIG. 2.

FIG. 2 is a front view of the paint distributing plate system 100*a* of FIG. 1, giving a better view of the attachment hook arrangements 106*a*, 106*b*, and FIG. 3 gives an even more detailed view of the adjustable attachment hook arrangements 106*a*, 106*b*. Each of the adjustable attachment hook arrangements 106*a*, 106*b* has an elongated fastening strip 110 with a hook 111 at one end thereof, and a locking profile 112 secured to one side of the upper part 105 of the distributing plate 103. The locking profile 112 locks the fastening strip 110 with the hook 111 extending a distance below the locking profile 112, where this distance is adjustable, so that the hook arrangement 106 can be adjusted to fit to paint bucket upper rims 102 of different widths or heights. The locking profile 112 and the hook 111 are designed so that the upper part of the upper rim 102 of a paint bucket 101 can rest against a lower part of the locking profile 112 and the lower part of the upper rim 102 of the paint bucket 101 can be hold by the hook 111, which is illustrated in FIG. 1.

It is preferred that the locking profile 112 has an aperture 113 through which a part of the fastening strip 110 is inserted and further has locking means 114*a*, 114*b* locking the inserted fastening strip 110 to the locking profile 112 with the hook 111 extending a distance below the locking profile 106, where this distance is a function of the length of the part of the fastening strip 110 being inserted through the aperture 113.

For a preferred embodiment, the hook 111 of the elongated fastening strip 110 is facing a first side surface of the strip where the fastening strip 110 further holds a plurality of ribs 115 and grooves 116 extending along a second side surface opposing the first side surface of the strip 110. This is illustrated in FIG. 3. Here, the fastening strip 110 is inserted through the aperture 113 with the hook 111 being below the aperture 113 and facing the distribution plate 103 with part of the ribs 115 and grooves 116 extending above the aperture 113. The locking means 114*a*, 114*b* of the locking profile 112 may comprise a locking pin 114*a* fitting into a groove 116 of the second side surface of the fastening strip 110 thereby locking the fastening strip 110 to the locking profile 112. The locking pin 114*a* is arranged at the locking profile 112 with the aperture 113 positioned between the distributing plate 103 and the locking pin 114*a*, and the locking profile 112 further holds a locking support 114*b* arranged at the other side of the aperture 113 opposing the locking pin 112, whereby the fastening strip 110 is locked between the locking support 114*b* and the locking pin 114*a*. It is preferred that the ribs 115 have a plane lower surface for contacting the locking pin 114*a*, and that the ribs 115 have a sloping or tilted upper surface. It is preferred that the locking pin 114*a* is made of a resilient material so that it can be bent or tilted at its position at the locking profile 112, thereby allowing the fastening strip 110 to be pulled further through the locking aperture 113 and allowing the locking pin 114*a* to be locked into another groove 116 of the fastening strip 110. In this way, the fastening strip 110 may be releasably locked to the locking profile 112. The aperture 113 should be arranged at a distance from the side of the paint distributing plate 103, thereby making space for the upper rim 102 of the paint bucket 101.

Figure 4:
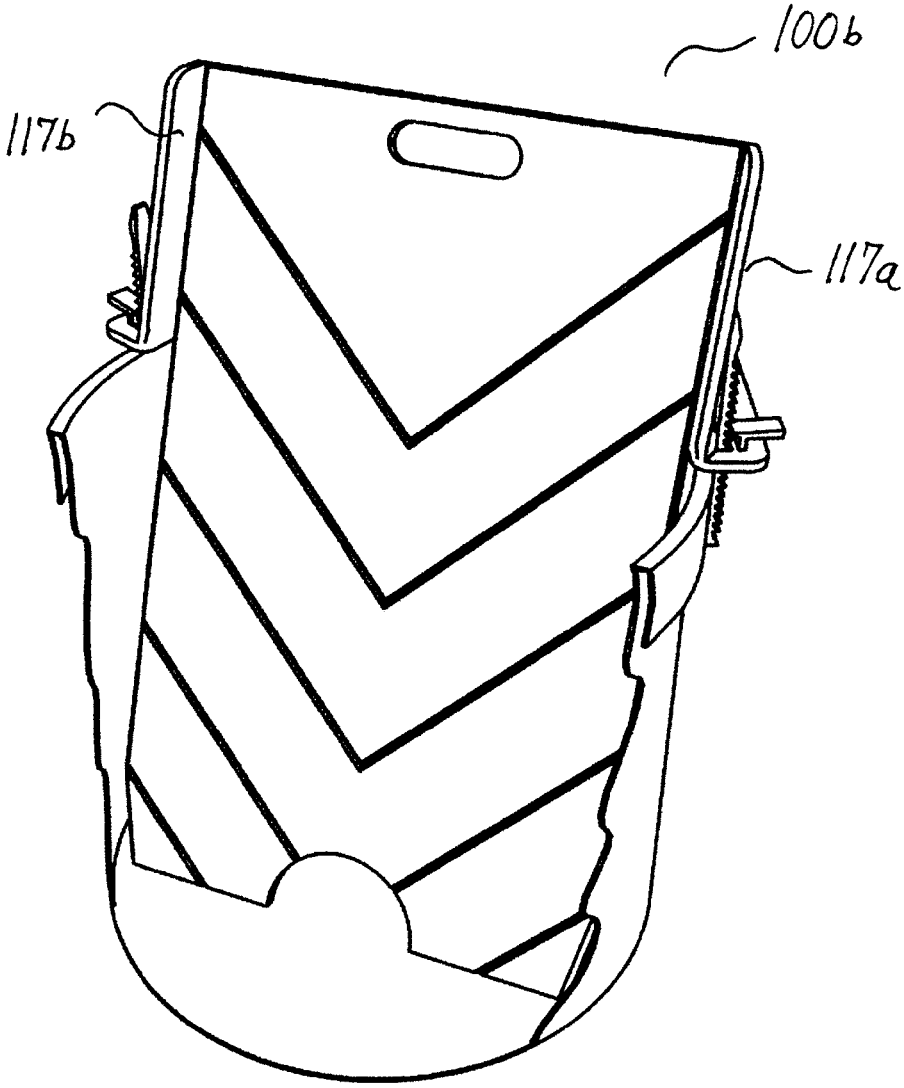
FIG. 4 is a perspective view of a second embodiment of a paint distributing plate system according to the invention, shown placed in a paint bucket, which has been cut for reasons of clarity.
Figure 5:
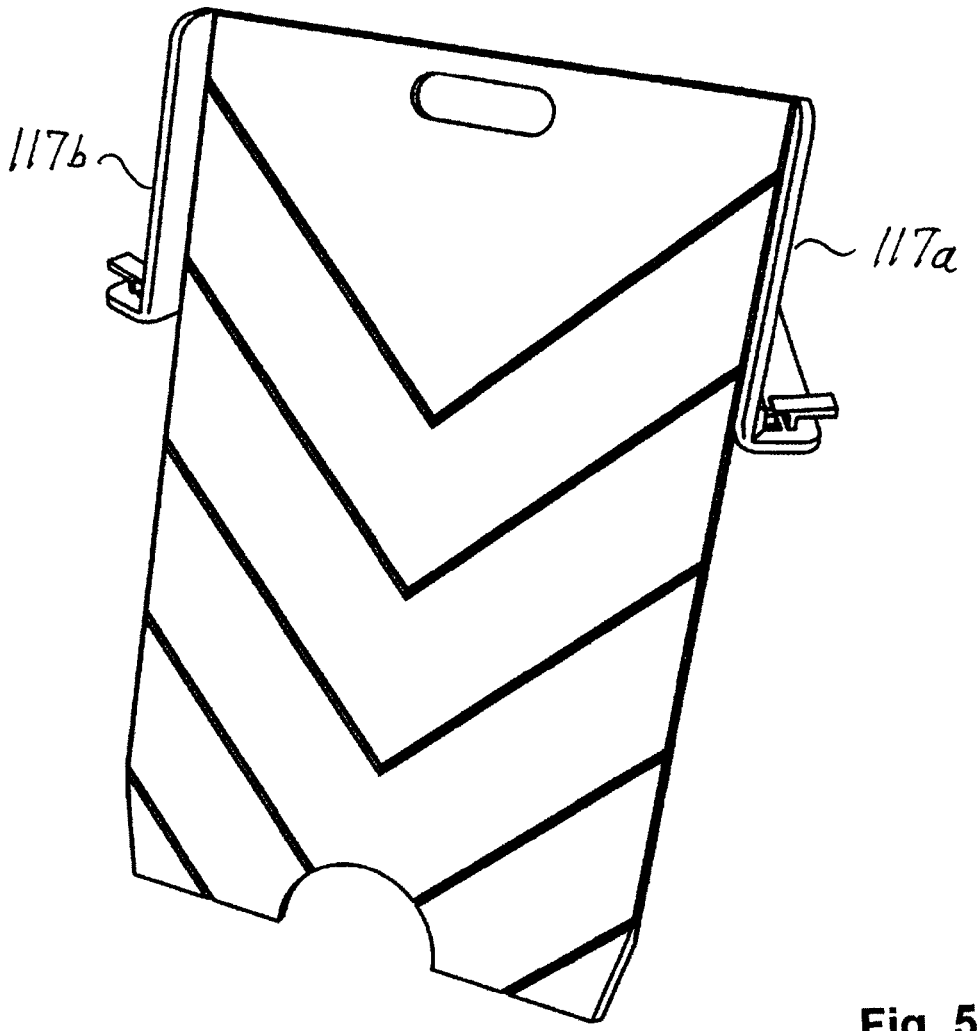
FIG. 5 is a front view of the paint distributing plate only of FIG. 4.
Figure 6:
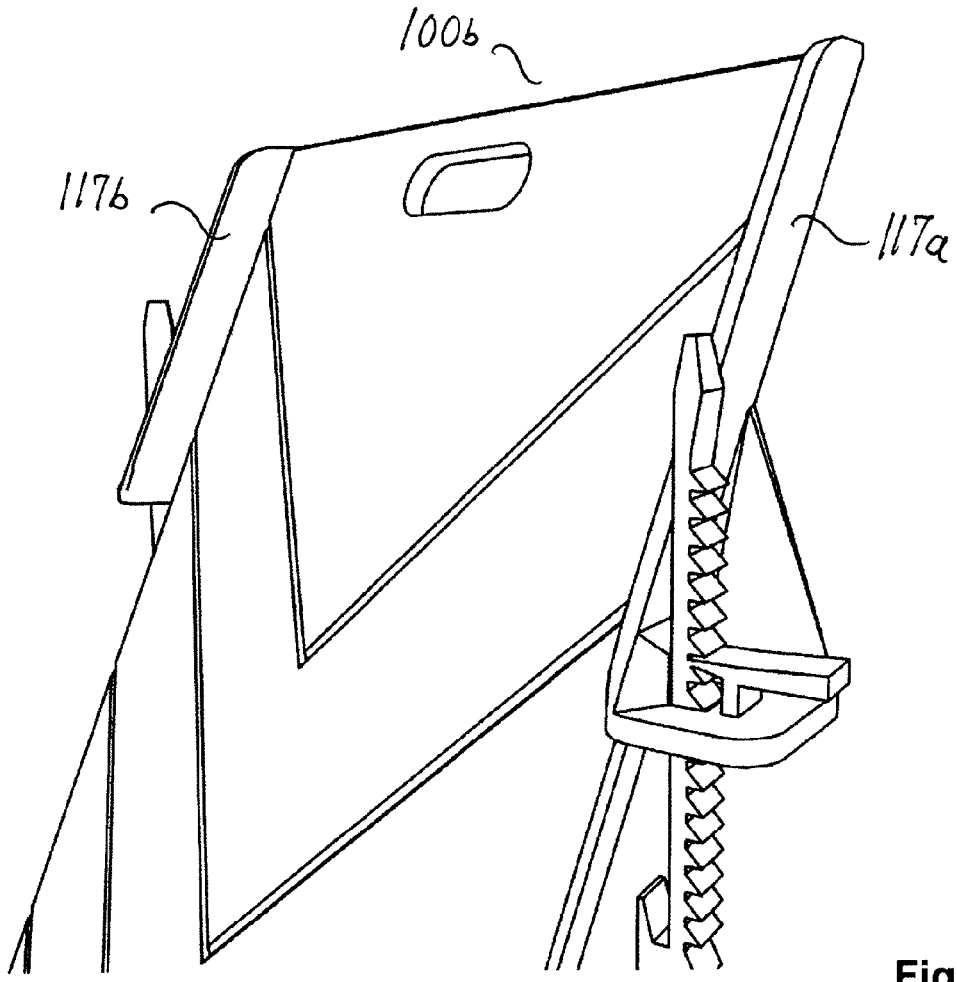
FIG. 6 is a more detailed view of the adjustable attachment hook arrangement of the plate system of FIG. 4.

FIGS. 4-6 show a second embodiment of a paint distributing plate system 100*b* according to the invention, where FIG. 4 is a perspective view of the second embodiment of the paint distributing plate system 100*b* placed in a paint bucket, FIG. 5 is a front view of the paint distributing plate of the second system 100*b*, and FIG. 6 is a more detailed view of the adjustable attachment hook arrangement of the second plate system 100*b*. The only difference between the first plate system 100*a* of FIG. 1 and the second plate system 100*b* of FIG. 4 is that for the second system 100*b* of FIG. 4, the upper part of the paint distributing plate comprises a pair of side flanges 117*a*, 117*b*, one on each side of the paint distributing plate, which side flanges 117*a*, 117*b* extend in an angle to the plate. The lower end of each of the side flanges 117*a*, 117*b* is connected to the locking profile being part of the hook arrangement.

By having side flanges 117*a*, 117*b* on the paint distributing plate, then excessive paint being pressed out from a paint roller or paint brush will not flow outside the paint distributing plate 103, but will be led down into the paint bucket 101 by the flanges 117*a*, 117*b*. It is also noted that when the paint distributing plate 103 is secured to the paint bucket 101 by the attachment hooks 106*a*, 106*b*, then the paint distributing plate 103 will be held safely in its position even when a pressing force is transferred to the plate 103 when a paint roller is pressed against the plate 103. When the plate 103 is secured to the bucket 102, it is also possible to lift the bucket 102 with paint and a roller together with the plate 103 at the same time.

In practice, the described paint distributing plate systems 100*a*, 100*b* may be made of plastic.

The invention claimed is:

1. A paint distributing plate system for insertion into a paint bucket having an external upper rim, the paint distributing plate system comprising:

a paint distributing plate with a lower part and an upper part, the lower part having a width being smaller than a diameter of a largest cross-sectional dimension of the paint bucket, and a pair of adjustable attachment hook arrangements provided on the upper part of the paint distributing plate, one on each side of the paint distributing plate, for securing the paint distributing plate to the upper rim of the paint bucket, one or each of the adjustable attachment hook arrangements comprises:

an elongated fastening strip with a hook at one end thereof, and a locking profile secured to one side of the upper part of the distributing plate, said locking profile locking the fastening strip with the hook extending a distance below the locking profile, said distance being adjustable by adjustably positioning said elongated fastening strip relative to said secured locking profile to change a position of said hook relative to said locking profile, whereby the hook arrangement is adjustable to secure the paint distributing plate to paint bucket upper rims of different widths or heights by changing said position of said hook relative to said locking profile and locking said locking profile.

2. The paint distributing plate system according to claim 1, wherein the locking profile and the hook arrangement are designed so that the upper part of the upper rim of a paint bucket can rest against a lower part of the locking profile and the lower part of the upper rim of the paint bucket can be held by the hook arrangement.

3. The paint distributing plate system according to claim 1, wherein the locking profile has an aperture through which a part of the fastening strip is inserted and further has locking means locking the inserted fastening strip to the locking profile with the hook arrangement extending a distance below the locking profile, said distance being adjustable and being a function of the length of the part of the fastening strip being inserted through the aperture.

4. The paint distributing plate system according to claim 1, wherein the hook arrangement of the elongated fastening strip is facing a first side surface of the strip and the fastening strip further has a plurality of ribs and grooves extending along a second side surface opposing the first side surface of the strip.

5. The paint distributing plate system according to claim 3, wherein the hook arrangement of the elongated fastening strip is facing a first side surface of the strip and the fastening strip further has a plurality of ribs and grooves extending along a second side surface opposing the first side surface of the strip and wherein the fastening strip is inserted through the aperture with the hook being below the aperture of the locking profile and facing the distribution plate and with part of the ribs and grooves extending above the aperture.

6. The paint distributing plate system according to claim 5, wherein the locking profile further has a locking pin fitting into a groove of the second side surface of the fastening strip thereby locking the fastening strip to the locking profile.

7. The paint distributing plate system according to claim 6, wherein the locking pin is arranged at the locking profile with the aperture positioned between the distributing plate and the locking pin, and wherein the locking profile further holds a locking support arranged at the other side of the aperture opposing the locking pin, whereby the fastening strip is locked between the locking support and the locking pin.

8. The paint distributing plate system according to claim 6, wherein the ribs have a planar lower surface for contacting the locking pin, and wherein the ribs have a sloping or tilted upper surface.

9. The paint distributing plate system according to claim 6, wherein the locking pin can be bent at its position at the locking profile, thereby allowing the fastening strip to be pulled further through the locking aperture and allowing the locking pin to be locked into another groove of the fastening strip.

10. The paint distributing plate system according to claim 3, wherein the aperture of the locking profile is arranged at a distance from the side of the paint distributing plate, thereby making space for the upper rim of the paint bucket.

11. The paint distributing plate system according to claim 1, wherein the fastening strip is releasably locked to the locking profile.

12. The paint distributing plate system according to claim 1, wherein a handle aperture is formed in the upper part of the paint distributing plate.

13. The paint distributing plate system according to claim 1, wherein the paint distributing plate comprises a plurality of paint distributing ridges serving as wiping elements for a paint brush or a paint roller.

14. The paint distributing plate system according to claim 1, wherein the paint distributing plate is provided with a through-flow opening at a bottom of the lower part.

15. The paint distributing plate system according to claim 1, wherein the upper part of the paint distributing plate comprises a pair of side flanges, one on each side of the paint distributing plate, which side flanges extend in an angle to the paint distributing plate.

16. The paint distributing plate system according to claim 1, wherein the upper part of the paint distributing plate comprises a pair of side flanges, one on each side of the paint distributing plate, which side flanges extend in an angle to the paint distributing plate and wherein the lower end of each of the side flanges is connected to a locking profile being part of a hook arrangement.

* * * * *